US006318376B1

(12) United States Patent
Cheng

(10) Patent No.: US 6,318,376 B1
(45) Date of Patent: Nov. 20, 2001

(54) FILTER TIP STRUCTURE FOR CIGARETTE

(76) Inventor: Chih-Wen Cheng, Fl. 2, No. 2, Tzu Chung St., Chung Li, Tao-Yuan Hsien (TW)

( * ) Notice: Subject to any disclaimer, the term of this patent is extended or adjusted under 35 U.S.C. 154(b) by 0 days.

(21) Appl. No.: 09/456,944

(22) Filed: Dec. 7, 1999

(51) Int. Cl.[7] ..... A24F 13/02; A24F 13/04; A24F 13/06

(52) U.S. Cl. ..... 131/215.2; 131/200; 131/201; 131/330; 131/173; 131/335

(58) Field of Search ..... 131/175, 187, 131/200, 331, 335, 336, 338, 339, 340, 215.1, 215.2, 215.3, 189, 201, 250

(56) References Cited

U.S. PATENT DOCUMENTS 3,650,278 * 3/1972 Cook ..... 131/215
3,695,274 * 10/1972 Summers ..... 131/10
4,009,724 * 3/1977 Prohroff ..... 131/187
4,158,364 * 6/1979 Ligeti ..... 131/187
4,273,142 * 6/1981 Swanson et al. ..... 131/339
4,275,745 * 6/1981 Carosone ..... 131/270
4,466,448 * 8/1984 Aikman ..... 131/216
4,711,254 * 12/1987 Fleisher et al. ..... 131/189
5,472,001 * 12/1995 Nicholson ..... 131/187
5,540,241 * 7/1996 Kim ..... 131/215.2
6,006,757 * 12/1999 Lichtenberg ..... 131/187

* cited by examiner

*Primary Examiner*—Stanley S. Silverman
*Assistant Examiner*—Carlos Lopez
(74) *Attorney, Agent, or Firm*—Rosenberg, Klein & Lee

(57) ABSTRACT

A cigarette filter tip structure includes a cigarette holder, and a filter base mounted on the bottom of the cigarette holder. The cigarette holder includes a compartment defined therein and having a bottom formed with a shoulder, the compartment having a center defining a compression hole, four L-shaped support bases each mounted in an inner wall of the compartment, and each having a bottom formed with a transversely extending positioning portion. The filter base has a top defining a filter recess for receiving the shoulder of the cigarette holder, and a bottom defining a passage and formed with a mouth suction portion. The filter base includes a plurality of filter pieces each located adjacent to the bottom of the filter recess, a plurality of filter spaces each defined between two adjacent filter pieces and each connecting to the passage, an oil collecting needle mounted in a center of the filter pieces and located under the compression hole, and a protruding ring mounted in the filter base and located between the filter recess and the passage, the protruding ring defining a through hole connecting between the filter spaces and the passage.

3 Claims, 2 Drawing Sheets

FILTER TIP STRUCTURE FOR CIGARETTE

BACKGROUND OF THE INVENTION

1. Field of the Invention

The present invention relates to a filter tip structure, and more particularly to a filter tip structure for a cigarette.

2. Description of the Related Art

A conventional cigarette filter tip comprises a filter tip base made of active carbon, a filter, and a cigarette pipe fitted with each other. The cigarette pipe has a two-layer cigarette support compartment of an inner cone, and a plurality of radiating arranged holes. The filter includes a collecting surface with a roughness, and an annular oil collecting groove located under the collecting surface. However, the conventional cigarette filter tip composed of a filter tip base made of active carbon, a filter, and a cigarette pipe includes multiple components, thereby greatly increasing the cost of manufacture. In addition, the conventional cigarette filter tip having a complex structure is not easily assembled and dismantled. Further, the two-layer cigarette support compartment in the cigarette pipe has a plane shape so that the cigarette cannot be rigidly and stably received in the two-layer cigarette support compartment. The present invention has arisen to mitigate and/or obviate the disadvantage of the conventional cigarette filter tip.

BRIEF SUMMARY OF THE INVENTION

In accordance with one aspect of the present invention, there is provided a cigarette filter tip structure comprising a cigarette holder having a compartment defined therein and having a bottom formed with a shoulder, the compartment having a center defining a compression hole, four L-shaped support bases each mounted in an inner wall of the compartment, and each having a bottom formed with a transversely extending positioning portion; and a filter base mounted on the bottom of the cigarette holder and having a top defining a filter recess for receiving the shoulder of the cigarette holder, and a bottom defining a passage and formed with a mouth suction portion, a plurality of filter pieces each mounted in the filter base and each located adjacent to the bottom of the filter recess, a plurality of filter spaces each defined between two adjacent filter pieces and each connecting to the passage, an oil collecting needle mounted in a center of the filter pieces and located under the compression hole, a protruding ring mounted in the filter base and located between the filter recess and the passage, the protruding ring defining a through hole connecting between the filter spaces and the passage.

Further benefits and advantages of the present invention will become apparent after a careful reading of the detailed description with appropriate reference to the accompanying drawings.

DETAILED DESCRIPTION OF THE INVENTION

Figure 1:
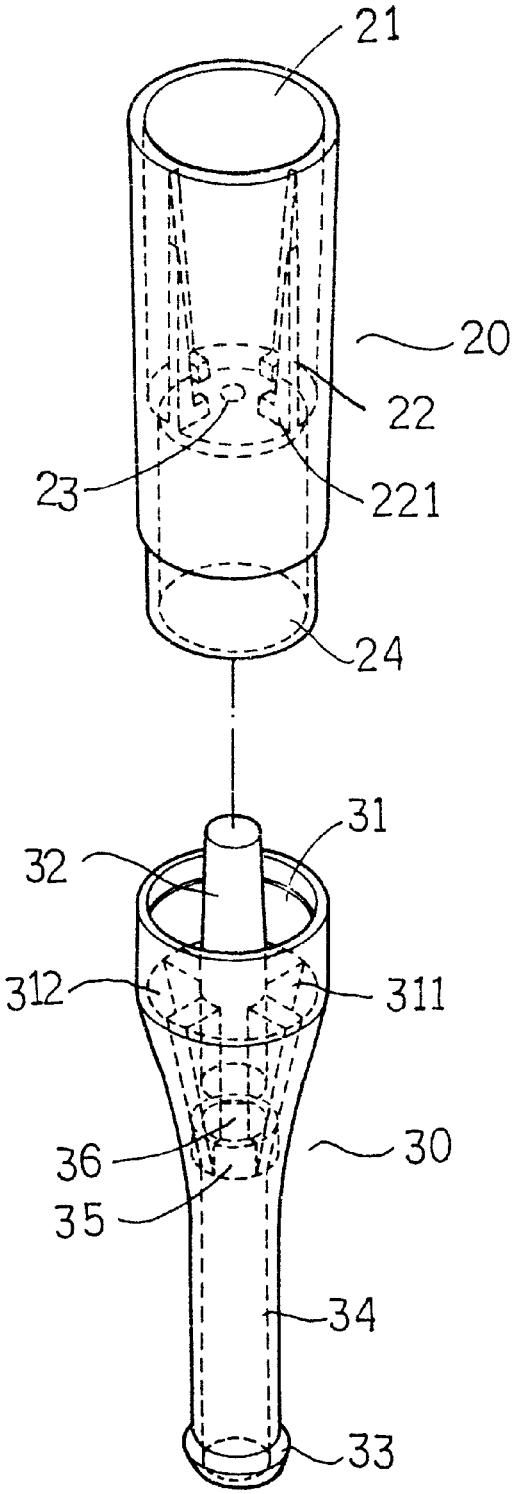
FIG. 1 is an exploded perspective view of a cigarette filter tip structure in accordance with the present invention.
Figure 2:
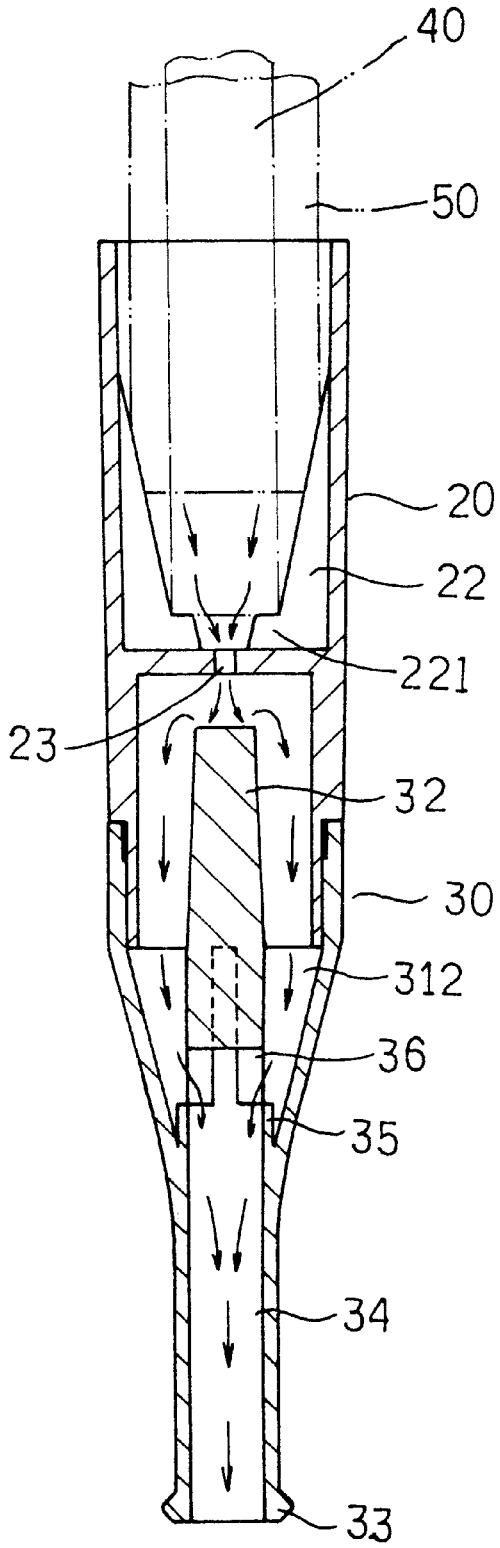
FIG. 2 is a front plan cross-sectional assembly view of the cigarette filter tip structure as shown in FIG. 1.

Referring to FIGS. 1 and 2, a cigarette filter tip structure in accordance with the present invention comprises a cigarette holder 20, and a filter base 30 mounted on the bottom of the cigarette holder 20. The cigarette holder 20 has a compartment 21 defined therein and has its bottom formed with a shoulder 24. The compartment 21 has a center defining a compression hole 23. Four L-shaped support bases 22 are each mounted in the inner wall of the compartment 21, and each have its bottom formed with a transversely extending positioning portion 221. Each of the support bases 22 is arranged in an inclined manner so that the cigarette holder 20 can be used to support cigarettes 40, 50 of different dimensions therein.

The filter base 30 has a top defining a filter recess 31 for receiving the shoulder 24 of the cigarette holder 20, and a bottom defining a passage 34 and formed with a mouth suction portion 33. A plurality of filter pieces 311 are each mounted in the filter base 30 and are each located adjacent to the bottom of the filter recess 31. A plurality of filter spaces 312 are each defined between two adjacent filter pieces 311 and each connect to the passage 34. An oil collecting needle 32 is mounted in a center of the filter pieces 311 and located under the compression hole 23. Preferably, the oil collecting needle 32 has a trapezoid shape. A protruding ring 35 is mounted in the filter base 30 and is located between the filter recess 31 and the passage 34. The protruding ring 35 defines a through hole 36 connecting between the filter spaces 312 and the passage 34.

By such an arrangement, the shoulder 24 of the cigarette holder 20 is fitted into the filter recess 31 of the filter base 30 so that the bottom of the shoulder 24 abuts the filter pieces 311 in the filter recess 31, thereby forming the entire cigarette filter tip structure. When the cigarette 40 is inserted into the compartment 21 of the cigarette holder 20, the support bases 22 can be used to enhance the stability of the cigarette 40. The smoke produced by the cigarette 40 is introduced into the lower portion of the cigarette holder 20 through the compression hole 23. The smoke introduced through the compression hole 23 into the filter base 30 directly hits the oil collecting needle 32 and the filter pieces 311 such that poisonous material contained in the smoke such as tar, nicotine and the like directly hits the oil collecting needle 32 and the filter pieces 311 in the filter recess 31, thereby attaching the heavier poisonous tar and nicotine contained in the smoke to the oil collecting needle 32 and the filter pieces 311, thereby achieving a filtering effect. When the filtered smoke is introduced into the through hole 36 of the protruding ring 35 through the filter spaces 312, the smoke directly hits the protruding ring 35 such that the tar contained in the smoke will be attached to the protruding ring 35, thereby greatly decreasing the amount of tar that enters and attaches to the passage 34.

Each of the support bases 22 is arranged in an inclined manner in the compartment 21 such that the cigarette holder 20 can be used for supporting cigarettes 40, 50 of different dimensions therein. In addition, the transversely extending positioning portion 221 of each of the support bases 22 can be used to support the cigarette 40 of a smaller dimension such that the cigarette 40 will not directly contact the bottom of the compartment 21.

It should be clear to those skilled in the art that further embodiments may be made without departing from the scope of the present invention.

What is claimed is:

1. A cigarette filter tip structure comprising:

a cigarette holder (20) having a compartment (21) defined therein and having a bottom formed with a shoulder (24), said compartment (21) having a center defining a compression hole (23), four L-shaped support bases (22) each mounted in an inner wall of said compartment (21), and each having a bottom formed with a transversely extending positioning portion (221); and a filter base (30) mounted on said bottom of said cigarette holder (20) and having a top defining a filter recess (31) for receiving said shoulder (24) of said cigarette holder (20), and a bottom defining a passage (34) and formed with a mouth suction portion (33), a plurality of filter pieces (311) each mounted in said filter base (30) and each located adjacent to the bottom of said filter recess (31), a plurality of filter spaces (312) each defined between two adjacent filter pieces (311) and each connecting to said passage (34), an oil collecting needle (32) mounted in a center of said filter pieces (311) and located under said compression hole (23), a protruding ring (35) mounted in said filter base (30) and located between said filter recess (31) and said passage (34), said protruding ring (35) defining a through hole (36) connecting between said filter spaces (312) and said passage (34).

2. The cigarette filter tip structure in accordance with claim 1, wherein each of said support bases (22) is arranged in an inclined manner.

3. The cigarette filter tip structure in accordance with claim 1, wherein said oil collecting needle (32) has a trapezoid shape.

* * * * *